US005492574A

United States Patent [19]

Huang

[11] Patent Number: 5,492,574

[45] Date of Patent: Feb. 20, 1996

[54] SINGLE PHASE TIAL ALLOY MODIFIED BY TANTALUM

[75] Inventor: Shyh-Chin Huang, Latham, N.Y.

[73] Assignee: General Electric Company, Schenectady, N.Y.

[21] Appl. No.: 309,701

[22] Filed: Sep. 21, 1994

[51] Int. Cl.[6] ..... C22C 14/00

[52] U.S. Cl. ..... 148/421; 148/670; 420/418; 420/421

[58] Field of Search ..... 420/418, 421; 148/421, 670

[56] References Cited

U.S. PATENT DOCUMENTS

| | | | |
|---|---|---|---|
| 3,203,794 | 8/1965 | Jaffee et al. | 420/418 |
| 4,294,615 | 10/1981 | Blackburn et al. | 75/175.5 |
| 4,842,817 | 6/1989 | Huang et al. | 420/418 |
| 5,028,491 | 7/1991 | Huang et al. | 428/614 |
| 5,098,653 | 3/1992 | Shyh-Chin | 420/418 |
| 5,324,367 | 6/1994 | Huang | 420/418 |

FOREIGN PATENT DOCUMENTS 621884 6/1961 Canada .

OTHER PUBLICATIONS

"Microstructures and Property Tradeoffs in Wrought Ti–Al–Base Alloys", Shyh–Chin Huang, Metallurgical Transactions A, vol. 23A, pp. 375–377, Jan. 1992.

"Titanium–Aluminum System", Bumps et al., Jounal of Metals, Jun. 1952, pp. 609–615, Transactions AIME, vol. 194.

"Mechanical Properties of High Purity Ti–Al Alloys", Ogden, et al., Journal of Metals, Feb. 1953, pp. 267–272, Transactions AIME, vol. 197.

"Ti–36 Pct Al as a Base for High Temperature Alloys", McAndrew, et al., Journal of Metals, Oct. 1956, pp. 1348–1353, Transactions AIME, vol. 206.

*Primary Examiner*—Scott Kastler

*Attorney, Agent, or Firm*—Edmund P. Anderson; James Magee, Jr.

[57] ABSTRACT

The present invention comprises a plurality of single phase gamma TiAl alloys modified by Ta. These alloys comprise $Ti_{(45-46)}Al_{(50-51)}Ta_4$ in atomic percent, and exhibit significant room temperature ductility, in the range of 1.3–2.1% tensile elongation. The alloys may be made by the use of cast and forging techniques.

10 Claims, No Drawings

SINGLE PHASE TIAL ALLOY MODIFIED BY TANTALUM

BACKGROUND OF THE INVENTION

The present invention relates generally to alloys of titanium and aluminum. More particularly, it relates to gamma (TiAl) alloys of titanium and aluminum that are stoichiometrically slightly Al-rich and modified by tantalum so as to produce a single phase TiAl structure.

It is known that as aluminum is added to titanium metal in greater and greater proportions the crystal form of the resultant titanium aluminum composition changes. Small percentages of aluminum go into solid solution in titanium and the crystal form remains that of alpha titanium. At higher concentrations of aluminum (including about 25 to 35 atomic %) an intermetallic compound $Ti_3Al$ is formed. The $Ti_3Al$ has an ordered hexagonal crystal form called alpha-2. At still higher concentrations of aluminum (including the range of 50 to 60 atomic % aluminum) another intermetallic compound, TiAl is formed having an ordered tetragonal crystal form called gamma.

The alloy of titanium and aluminum having a gamma crystal form and a stoichiometric ratio of approximately one is an intermetallic compound having a high modulus, a low density, a high thermal conductivity, good oxidation resistance, and good creep resistance. The relationship between the modulus and temperature for TiAl compounds to other alloys of titanium and in relation to nickel base superalloys has been shown previously, as for example in U.S. Pat. No. 4,842,817. As noted in this reference, TiAl has the highest modulus of any of the titanium alloys. Not only is the TiAl modulus higher at temperature but the rate of decrease of the modulus with temperature increase is lower for TiAl than for other titanium aluminum alloys. Moreover, the TiAl retains a useful modulus at temperatures above those at which the other titanium alloys become useless. Alloys which are based on the TiAl intermetallic compound are attractive lightweight materials for use where high modulus is required at high temperatures and where good environmental protection is also required.

One of the characteristics of TiAl which limits its actual application to such uses is a brittleness which is found to occur at room temperature. Also, the strength of the intermetallic compound at room temperature needs improvement before the TiAl intermetallic compound can be exploited in structural component applications. Improvements of the TiAl intermetallic compound to enhance ductility and/or strength at room temperature are very highly desirable in order to permit use of the compositions at the higher temperatures for which they are suitable.

With potential benefits of light weight and at high temperatures strength, what is most desired in the TiAl compositions which are to be used is a combination of strength and ductility at room temperature. A minimum ductility of the order of one percent is acceptable for some applications of the metal composition but higher ductilities are much more desirable. A minimum strength for a composition to be useful is about 50 ksi or about 350 MPa. However, materials having this level of strength are of marginal utility and higher strengths are often preferred for some applications.

The stoichiometric ratio of TiAl compounds can vary over a range without altering the crystal structure. The aluminum content can vary from about 50 to about 60 atom percent. The properties of TiAl compositions are subject to very significant changes as a result of relatively small changes of one percent or more in the stoichiometric ratio of the titanium and aluminum constituents. Also, the properties are similarly affected by the addition of relatively similar small amounts of ternary elements.

PRIOR ART

There is extensive literature on the compositions of titanium aluminum including the $Ti_3Al$ intermetallic compound, the TiAl intermetallic compounds and the $TiAl_3$ intermetallic compound. U.S. Pat. No. 4,294,615, entitled "Titanium Alloys of the TiAl Type" contains an extensive discussion of the titanium aluminide type alloys including the TiAl intermetallic compound. As is pointed out in the patent in column 1 starting at line 50 in discussing TiAl's advantages and disadvantages relative to $Ti_3Al$:

> "It should be evident that the TiAl gamma alloy system has the potential for being lighter inasmuch as it contains more aluminum. Laboratory work in the 1950's indicated that titanium aluminide alloys had the potential for high temperature use to about 1000° C. But subsequent engineering experience with such alloys was that, while they had the requisite high temperature strength, they had little or no ductility at room and moderate temperatures, i.e., from 20° to 550° C. Materials which are too brittle cannot be readily fabricated, nor can they withstand infrequent but inevitable minor service damage without cracking and subsequent failure. They are not useful engineering materials to replace other base alloys."

It is known that the alloy system TiAl is substantially different from $TiAl_3$ (as well as from solid solution alloys of Ti) although both TiAl and $Ti_3Al$ are basically ordered titanium aluminum intermetallic compounds. As the U.S. Pat. No. 4,294,615 points out at the bottom of column 1:

> "Those well skilled recognize that there is a substantial difference between the two ordered phases. Alloying and transformational behavior of $Ti_3Al$ resemble those of titanium as the hexagonal crystal structures are very similar. However, the compound TiAl has a tetragonal arrangement of atoms and thus rather different alloying characteristics. Such a distinction is often not recognized in the earlier literature."

A number of technical publications dealing with the titanium aluminum compounds as well as with the characteristics of these compounds are as follows:

1. E. S. Bumps. H. D. Kessler, and M. Hansen, "Titanium-Aluminum System", Journal of Metals, June, 1952, pp. 609–615, TRANSACTIONS AIME, Vol. 194.
2. H. R. Ogden, D. J. Maykuth, W. L. Finlay, and R. I. Jaffee, "Mechanical Properties of High Purity Ti-Al Alloys", Journal of Metals, February, 1953, pp. 267–272, TRANSACTIONS AIME, Vol. 197.
3. Joseph B. McAndrew and H. D. Kessler, "Ti-36 Pct Al as a Base for High Temperature Alloys", Journal of Metals, October, 1956, pp. 1348–1353, TRANSACTIONS AIME, Vol. 206.

This latter paper discloses on page 1353 a composition of titanium-35 weight percent aluminum and 7 weight percent tantalum. On an atomic percent scale this is equivalent to $Ti_{47.5}Al_{51}Ta_{1.5}$. This composition is stated to have an ultimate tensile strength of 71,060 psi and a ductility of about 1.5% and is discussed further below.

U.S. Pat. Nos. 4,842,817 and 5,028,491 also describe certain benefits to be obtained by the addition of Ta and Ta/Cr, respectively. The '817 and '491 patents are also discussed further below.

BRIEF DESCRIPTION OF THE INVENTION

The present invention comprises a Ta modified TiAl alloy that is stoichiometrically Al rich, and which is characterized by the fact that it has significant ductility and tensile strength at room temperature, and, significantly, by the fact that it exhibits a one phase microstructure.

The invention comprises a tantalum modified TiAl alloy consisting essentially of titanium, aluminum and tantalum in the following approximate atomic ratio:

$$Ti_{45-46}Al_{50-51}Ta_{4},$$

said alloy existing in a single phase.

One object of the present invention is to provide a TiAl intermetallic compound that exists as a one phase alloy, and that has substantial ductility and tensile strength at room temperature. Another object is to provide a method of forming a TiAl alloy having the characteristics described herein by using conventional cast and wrought metal forming techniques. Another object is to provide a one phase TiAl alloy which should have enhanced creep resistance as compared to two phase TiAl alloys having similar related compositions.

Other objects, features and advantages of the present invention may be apparent from the discussion and description set forth herein.

DETAILED DESCRIPTION OF THE INVENTION

Tantalum has been used previously as a alloy modifying addition in TiAl alloys that are nearly stoichiometric TiAl (Ti-50Al in atomic percent). U.S. Pat. Nos. 4,842,817 and 5,028,491, which are herein incorporated by reference, both describe such alloys. However, the alloys reported in these patents are almost all Al-lean, in that they have less than 50 atomic percent Al. Alloy 162 reported in Table VII of the U.S. Pat. No. 5,028,491 is the one exception to this observation, in that it has exactly 50 atomic percent. However, Alloy 162 and the other Ta-modified alloys are all two-phase alloys. Applicant has observed that while these Al-lean alloys are comprised largely of gamma phase (TiAl), and hence may properly be referred to as gamma alloys, that small quantities of a second phase $Ti_3Al$ also exist within these alloys. The formation of the second phase allows the control of structure which benefits the ductility. However, well known principals related to creep phenomena would suggest that single phase TiAl alloys should have greater creep resistance, particularly steady-state creep resistance, than such two phase TiAl with similar compositions, particularly if the second phase is allowed to segregate to the grain boundaries. The desirability of developing single phase versus two phase microstructures with respect to developing creep resistant TiAl alloys has been specifically addressed, see Huang, *Microstructures and Property Tradeoffs in Wrought TiAl-base Alloys,* METALLURGICAL TRANSACTIONS A, Vol. 23A, 375–377, January 1992.

The presence of the $Ti_3Al$ in the more ductile and stronger two phase alloys also increases the sensitivity of the alloy to hydrogen attack. Compared with the parent phase TiAl, $Ti_3Al$ has a more open crystal structure and can absorb hydrogen more easily, causing hydrogen embrittlement. For applications in a hydrogen-rich environment, the use of a single phase gamma alloy is clearly much more desirable than a two phase alloy.

Therefore, the motivation for the work described in the examples set forth herein was to develop a single phase alloy of near stoichiometric TiAl without causing significant reduction in low temperature properties such as ductility and tensile strength, or reductions in high temperature properties such as oxidation resistance. Tantalum was considered as an alloying constituent for the desired single phase alloy because of its known oxidation and ductility enhancement in two phase alloys as discussed in the referenced patents described above.

Therefore, Applicant devised the experiments described in the examples below to investigate the possibility of developing a single phase TiAl alloy having Ta as an alloy constituent. A series of slightly Al-rich (having atomic concentrations of ≧50 percent Al) alloys were investigated. Such Al-rich alloys are known to have somewhat reduced mechanical properties as compared to alloys that are slightly Al-lean, however, Applicant determined to investigate such Al-rich alloys in an attempt to produce a single phase material, while maintaining the other desirable alloy characteristics. It should be noted that while Alloy 162 referenced above was an Al-rich alloy according to the definition set forth above, this alloy was not utilized for these experiments because this alloy, which also contained Cr as an alloy constituent, was known to produce a two phase alloy.

The experiments were conducted by preparing a series of Al rich TiAl alloys having Ta as a modifying constituent as described, and a series of Al rich TiAl alloys having the same Al concentration without the Ta modifying addition for comparison. The results are set forth in the examples below.

EXAMPLES 1–4

Four binary TiAl alloys with Al contents greater than or equal to the stoichiometric composition were investigated. They were Ti-50Al, Ti-51Al, Ti-52Al, and Ti-54Al, all in atomic percent. Each alloy was made into an ingot by electro-arc melting of a mix of elemental titanium and aluminum and processed into ribbon by melt-spinning (ms) in a vacuum. In both stages of the melting, a water-cooled copper hearth was used as the container for the melt to avoid undesirable melt/container reactions. Also care was taken to void exposure of the hot metal to oxygen because of the strong affinity of titanium for oxygen. The rapidly solidified ribbon was packed into a steel can which was evacuated and sealed. The can was then hot isostatically pressed (HIPed) at 950° C. and 207 MPa for 3 hours. After HIPing, the steel can was machined off yielding a plug of the TIAl alloy about 1 inch in diameter and 3 inches long. This plug was placed axially into a center opening a billet of steel and sealed therein. The billet was heated to a temperature of 975° C. and extruded through a die to give a reduction ratio of about 7 to 1. The extruded plug was removed from the billet and heat treated at a series of temperatures in the range of 1300–1425° C. for 2 hours. The annealed plugs were then aged at 1000° C. for 2 hours. Tensile specimens were machined from these alloys for testing at room temperature. The results of the room temperature tensile tests are summarized in Table 1. The yield strength of the Ti-50Al alloy was found to decrease with an increasing heat-treatment temperature. On the other hand, the ductility increased and then decreased with the heat treatment temperature. An optimum combination of strength and ductility occurred at the heat treatment temperature of 1375° C. The Ti-51Al alloy showed a similar effect of heat treatment temperature on the tensile properties. For this alloy, the optimum strength and ductility combination occurred at the 1400° C. heat treatment. A metallography study showed that the samples of the above two alloys had a two phase structure. The volume fraction of the second phase and the grain size of the alloy increased with the heat treatment temperature.

By comparison, the Ti-52Al and Ti-54Al alloys processed by the same technique (melt-spinning and extrusion) showed lower strength and ductilities. Unlike the Ti-50Al and Ti-51Al alloys, the tensile properties of the Ti-54Al alloy were not significantly affected by the heat treatment temperature. The metallography study showed that these two Al-rich alloys were essentially single phase TiAl materials. The TiAl phase limit is thus between 51Al and 52Al for the binary alloy studied here by the melt-spinning and extrusion technique.

The Ti-52Al alloy was also processed by the cast and wrought or cast and forge method. More specifically, the alloy was melted by electro-arc melting of a mix of elemental titanium and aluminum and cast into an ingot about two inches in diameter and about one half inch thick. After the ingot was homogenized for two hours at 1250° C., it was enclosed in a steel ring and heated to 975° C. The heated ingot and ring assembly was then forged to a thickness approximately one-half that of the original thickness. After annealing specimens at a range of temperatures between 1200° C. and 1400° C. for two hours followed by aging at 1000° C. for two hours, tensile specimens were machined for testing at room temperature.

The Ti-52Al alloy processed by the cast and forge method showed lower yield strength and ductility than its counterpart processed by melt-spinning and extrusion. A metallography study indicated that the cast and forged Ti-52Al alloy was also a single phase material, but with a larger grain size. The oxygen concentration in the cast and forged material was also lower. In addition, several binary alloys with Al contents higher than 54Al were processed. Those alloys failed to produce materials suitable for tensile tests. They were very brittle, breaking into pieces during machining.

Three TiAl-base alloys modified by Ta additions were also investigated. Two of the alloys, Ti-50Al -4Ta and Ti-52Al-4Ta, were processed by the melt-spinning and extrusion technique described previously. The Ti-50Al-4Ta-alloy was also processed by the cast and forge method described previously as was the third alloy, Ti-51Al-4Ta, except that a different homogenization temperature of 1400° C. was employed for some of the specimens. Tensile specimens were made as described above for the TiAl alloys. The tensile test results of these Ta-modified alloys are summarized in Table 2.

The Ti-50Al-4Ta alloy was a two phase alloy and showed a yield strength of 61–70 ksi and a ductility of 1.7–2.2 percent plastic elongation when processed by melt-spinning and extrusion. This is comparable to the binary Ti-50Al alloy reported in Table 1 which was also two phase and had a 52–65 ksi yield strength and 0.8–2.1 percent plastic elongation when processed by melt-spinning and extrusion. The Ta modification in this instance appears to provide only modest improvements in strength and ductility for melt-spun materials. However, the cast and wrought Ti-50Al-4Ta and Ti-51Al-4Ta specimens exhibited different and unexpected properties. Firstly, a metallography study on the materials indicated that both alloys were single phase materials. This included the Ti-50Al-4Ta alloy homogenized at 1400° C. These was a surprising result in consideration of the two phase nature of the same TiAl alloys made by melt-spinning and extrusion. Secondly, the yield strength of 38–50 ksi for the single phase cast and forged Ti-50Al-4Ta and Ti-51Al-4Ta was somewhat lower than the two phase TiAl materials, as was expected for a single phase alloy. However, unexpectedly, the ductility as measured by tensile elongation was not diminished as was the case for the cast and forged Ti-52Al and Ti-54Al alloys, and remained in the range of 1.3–2.1 percent. This is believed to provide a significant advantage, because it provides several alloy compositions that have Ta added for oxidation resistance and are single phase so as to provide enhanced creep resistance, while retaining significant room temperature ductility and yield strength.

The Ti-52Al-4Ta was also single phase and had a modest yield strength, but it had relatively low ductility as compared to the Ti-50Al-4Ta and Ti-51Al-4Ta alloys, with plastic elongation in the range of 0.3–1.1. These results are reasonably consistent with those of the corresponding binary alloy Ti-52Al when processed by cast and forge techniques.

This is particularly significant in light of data referenced above pertaining to the prior art $Ti_{47.5}Al_{51}Ta_{1.5}$ (in atomic percent) alloy described above in the McAndrew et al. reference. The ductility gains observed with the additional quantities of tantalum (and consequent reduced quantities of Ti) in the alloys described herein are significant, ranging from ductilities of 1.3–2.2 percent plastic elongation. These represent gains of up to about 47 percent in ductility. These are not insignificant gains given the difficulties in achieving ductilities greater than 1 percent described herein and in the references set forth above. The reference noted also does not indicate whether this alloy was a one phase or two phase alloy, which is significant in light of the data of Table 1 and Table 2 which indicate that very minor additions in these alloys can make a difference between the formation of a one phase and two phase microstructure. In this context, a 2.5 percent difference in the atomic concentration of tantalum could be very significant.

With regard now to U.S. Pat. No. 4,842,817, though this reference describes TiAl alloys that were modified by Ta, it deals only with Al-lean alloy compositions that resulted in two phase alloys. The alloys of the present invention also generally have smaller yield strengths and greater ductility than the alloys referenced in the '817 patent.

With regard to U.S. Pat. No. 5,028,491, though this reference also describes TiAl alloys that were modified by Ta, it deals primarily with Al-lean alloy compositions that resulted in two phase alloys. The exceptions were the alloy composition Ti-50Al-2Cr-2Ta and Ti-50Al-2Cr-4Ta, these alloys were also observed have two phase microstructures. In general, Cr has been observed to stabilize the second ($Ti_3Al$) phase. The yield strengths of these alloys were also higher (67–79 ksi versus 38–50 ksi)), and the ductilities lower (0.5–1.5% versus 1.3–2.1%), than those of the alloys of the present invention.

TABLE 1

ROOM TEMPERATURE TENSILE PROPERTIES OF Al-RICH TiAl-BASE ALLOYS

| Alloy # | Atomic Composition | Processing | Microstructure | Ingot Homogenization Temperature (°C.) | Heat Treatment Temp. (°C.) | Y.S. (ksi) | F.S. (ksi) | Plastic Elongation (%) |
|---|---|---|---|---|---|---|---|---|
| 85 | Ti—50Al | MS & extrude | two-phase | — | 1300 | 65 | 70 | 0.8 |
| | | | | — | 1350 | 62 | 67 | 1.5 |
| | | | | — | 1375 | 60 | 69 | 2.1 |
| | | | | — | 1400 | 53 | 67 | 1.7 |
| | | | | — | 1425 | 52 | 64 | 1.4 |
| 113 | Ti—51Al | MS & extrude | two-phase | — | 1350 | 67 | 71 | 0.3 |
| | | | | — | 1375 | 75 | 77 | 0.7 |
| | | | | — | 1400 | 60 | 67 | 1.7 |
| | | | | — | 1425 | 57 | 66 | 1.6 |
| 11 | Ti—52Al | MS & extrude | single-phase | — | 1400 | 51 | 58 | 1.1 |
| | | Cast & forge | single-phase | 1250 | 1200 | 32 | 32 | 0.2 |
| | | | | 1250 | 1300 | 32 | 32 | 0.2 |
| | | | | 1250 | 1400 | 36 | 40 | 0.5 |
| 122 | Ti—54Al | MS & extrude | single-phase | — | 1350 | 50 | 56 | 0.7 |
| | | | | — | 1375 | 49 | 57 | 0.9 |
| | | | | — | 1400 | 53 | 58 | 0.8 |
| | | | | — | 1425 | 52 | 60 | 1.0 |

TABLE 2

ROOM TEMPERATURE TENSILE PROPERTIES OF Ta-MODIFIED, Al-RICH TiAl-BASE ALLOYS

| Alloy # | Atomic Composition | Processing | Microstructure | Ingot Homogenization Temperature (°C.) | Heat Treatment Temp. (°C.) | Y.S. (ksi) | F.S. (ksi) | Plastic Elongation (%) |
|---|---|---|---|---|---|---|---|---|
| 104 | Ti—50Al—4Ta | MS & extrude | two-phase | — | 1325 | 70 | 75 | 1.7 |
| | | | | — | 1350 | 70 | 78 | 2.1 |
| | | | | — | 1375 | 61 | 77 | 2.2 |
| | | Cast & forge | single-phase | 1250 | 1325 | 38 | 49 | 1.6 |
| | | | | 1250 | 1350 | 42 | 55 | 1.8 |
| | | | | 1250 | 1375 | 47 | 60 | 1.7 |
| | | Cast & forge | single-phase | 1400 | 1300 | 46 | 57 | 1.7 |
| | | | | 1400 | 1325 | 47 | 61 | 2.1 |
| | | | | 1400 | 1350 | 50 | 66 | 2.1 |
| 152 | Ti—51Al—4Ta | Cast & forge | single-phase | 1400 | 1325 | 41 | 51 | 1.3 |
| | | | | 1400 | 1350 | 44 | 55 | 1.6 |
| | | | | 1400 | 1375 | 46 | 56 | 1.3 |
| 124 | Ti—52Al—4Ta | MS & extrude | single-phase | — | 1250 | 50 | 55 | 0.7 |
| | | | | — | 1300 | 58 | 58 | 0.3 |
| | | | | — | 1350 | 55 | 57 | 0.8 |
| | | | | — | 1375 | 55 | 61 | 0.3 |
| | | | | — | 1400 | 62 | 63 | 1.1 |

What is claimed is:

1. A tantalum modified titanium aluminum alloy consisting essentially of titanium, aluminum and tantalum in the following approximate atomic ratio:

$$Ti_{45-46}Al_{50-51}Ta_4,$$

said alloy having a single phase gamma microstructure.

2. The alloy of claim 1, said alloy having a ductility as measured by tensile elongation in the range of 1.3–2.2 percent.

3. The alloy of claim 1 having a tensile strength of 49 ksi or greater.

4. The alloy of claim 1, wherein said alloy has a yield strength of 38 ksi or greater.

5. A tantalum modified titanium aluminum alloy consisting essentially of titanium, aluminum and tantalum in the following approximate atomic ratio:

$$Ti_{45-46}Al_{50-51}Ta_4,$$

said alloy having been formed by a method of casting and forging, and wherein said alloy is homogenized prior to forging.

6. The alloy of claim 5, wherein said alloy is heat treated after forging at a temperature in the range of 1300–1375° C.

7. The alloy of claim 5, wherein the alloy is homogenized at a temperature in the range of 1250–1400° C.

8. The alloy of claim 7, wherein said alloy is a single phase gamma alloy.

9. The alloy of claim 8, wherein said alloy has a ductility as measured by tensile elongation in the range of 1.3–2.2 percent.

10. The alloy of claim 5, wherein the homogenization temperature is in the range of 1250–1400° C.

* * * * *